United States Patent [19]

Gaster

[11] Patent Number: 4,575,095

[45] Date of Patent: Mar. 11, 1986

[54] SPACE COMBAT GAME

[76] Inventor: Eugene Gaster, 207 Paradise, Madison, Ohio 44057

[21] Appl. No.: 544,518

[22] Filed: Oct. 24, 1983

[51] Int. Cl.[4] ..... A63F 3/00

[52] U.S. Cl. ..... 273/253; 273/143 R

[58] Field of Search ..... 273/250, 253, 143 R

[56] References Cited

U.S. PATENT DOCUMENTS

| | | | |
|---|---|---|---|
| 2,535,474 | 3/1950 | Zerpa . | |
| 2,842,368 | 7/1958 | Williams | 273/143 R |
| 3,037,773 | 7/1962 | Chambers et al. | 273/253 |
| 3,099,451 | 11/1963 | Newhouse | 273/253 |
| 3,223,420 | 12/1965 | Turner | 273/253 |
| 3,514,111 | 4/1970 | Crawford | 273/238 |
| 3,865,379 | 7/1975 | Breslow . | |
| 3,948,527 | 4/1976 | Aguirregomezcorta | 273/253 |
| 3,973,775 | 8/1976 | Bolan | 273/253 |
| 3,985,361 | 12/1976 | Millen | 273/250 |
| 4,003,577 | 1/1977 | Bolach . | |
| 4,111,427 | 6/1978 | Patterson | 273/250 |
| 4,114,891 | 10/1978 | Lawrimore . | |
| 4,247,113 | 3/1981 | La Capra . | |
| 4,385,765 | 5/1983 | Munn et al. | 273/253 |

*Primary Examiner*—Richard C. Pinkham
*Assistant Examiner*—Scott L. Brown
*Attorney, Agent, or Firm*—Porter & Bremer Co.

[57] ABSTRACT

A space combat game is disclosed herein which includes a game board having playing spaces and a plurality of groups of planetary, directional, internment, battle, safety and control spaces each having specific rules of play. Die is provided to determine the number of spaces a player must travel in a turn. An attack success indicator is provided to determine the outcome of an attack of one player on another. A player score sheet is also included to accurately record the total number of points received by a player during the game.

15 Claims, 5 Drawing Figures

62

| ★TRIPS! | POINT VALUE | GAME № 1 | 2 | 3 | 4 |
|---|---|---|---|---|---|
| MOON TRIP | 300 | | | | |
| GALAXY TRIP | 50 | | | | |
| **★HITS!** | | | | | |
| DIRECT HIT ON ENEMY | 100 | | | | |
| **★CONTROLS!** | | | | | |
| MISSION CONTROL | 200 | | | | |
| MOON CONTROL | 150 | | | | |
| SPACE STATION CONTROL | 100 | | | | |
| TRIPLE CONTROL | 150 | | | | |
| **★CAPTURES!** | | | | | |
| ROBOT | 150 | | | | |
| ASTRONAUT | 100 | | | | |
| MARTIAN | 50 | | | | |
| **★REMAINING FORCE!** | | | | | |
| ROBOT | 70 | | | | |
| ASTRONAUT | 60 | | | | |
| ROCKET SHIP | 50 | | | | |
| TOTAL | | | | | |

64

SPACE COMBAT GAME

BACKGROUND OF THE INVENTION

1. Field of the Invention

This invention relates to games and, more particularly, to a space conquest type game in which the players seek to conquer the solar system and accumulate a maximum number of points.

2. Description of the Prior Art

Space journey games having a playing board with a number of spaces disposed on the surface thereof have generally been known for many years. Typically, these games include playing pieces of more than one player which are moved through a path of spaces in an attempt by a particular player to obtain a maximum amount of points and win conquest of space. The player operates a spinner, dice or other chance means to determine the number of spaces which can be moved in a particular turn. After a requisite number of turns, completion of a space voyage, or if a player or players has been eliminated from the game, play is normally ended. Representative of the above-described well-known games are those described in U.S. Pat. Nos. 4,111,427 and 3,985,361.

All such games contain some distinctive feature in the rules and method of play to distinguish one from the other. Typically, each game provides a different means by which players can accumulate points or destroy the pieces of the other players. However, such games are normally based purely on chance and consist of little more than the players moving along a continuous path from a launch pad to a landing pad or planet for a certain amount of points or other reward. No game provides a complete assortment of all the perils, adventures or combative predicaments which may be present in a solar system or other portion of the universe, and no game effectively allows the player to incorporate battle strategy and tactics into the play of the game.

SUMMARY OF THE INVENTION

Accordingly, it is a primary objective of the present invention to provide a novel game which allows players to develop and utilize a battle strategy to obtain a maximum amount of points.

Another object of the present invention is to provide an amusing and exciting game for two or more players which provides interesting challenges and obstacles during the play of the game.

In accordance with an aspect of the present invention a space combat game is herewith disclosed and includes a game board with a play surface having a plurality of playing spaces disposed thereon and which are in a continuous path. Indicia are printed on the game board and the playing spaces thereby defining a group of planetary spaces, directional spaces, internment spaces, control spaces, battle spaces and safety spaces. A black hole space is provided to simulate a realistic obstacle for the players. A first and second chance means are provided to determine the number of moves a player may move a marker during his turn, and to determine the outcome of a battle between two players, respectively. Galaxy cards, scoring disks and a scoring means are also provided to introduce an element of chance, and a means to determine the score of a particular player throughout the play of the game, respectively.

BRIEF DESCRIPTION OF THE DRAWINGS

The foregoing and other objects, advantages and characterizing features of the present invention will become clearly apparent from the ensuing detailed description of an illustrative embodiment thereof, taken together with the accompanying drawings wherein like reference numerals denote like parts throughout the various views and in which.

DESCRIPTION OF THE PREFERRED EMBODIMENT

Figure 1:
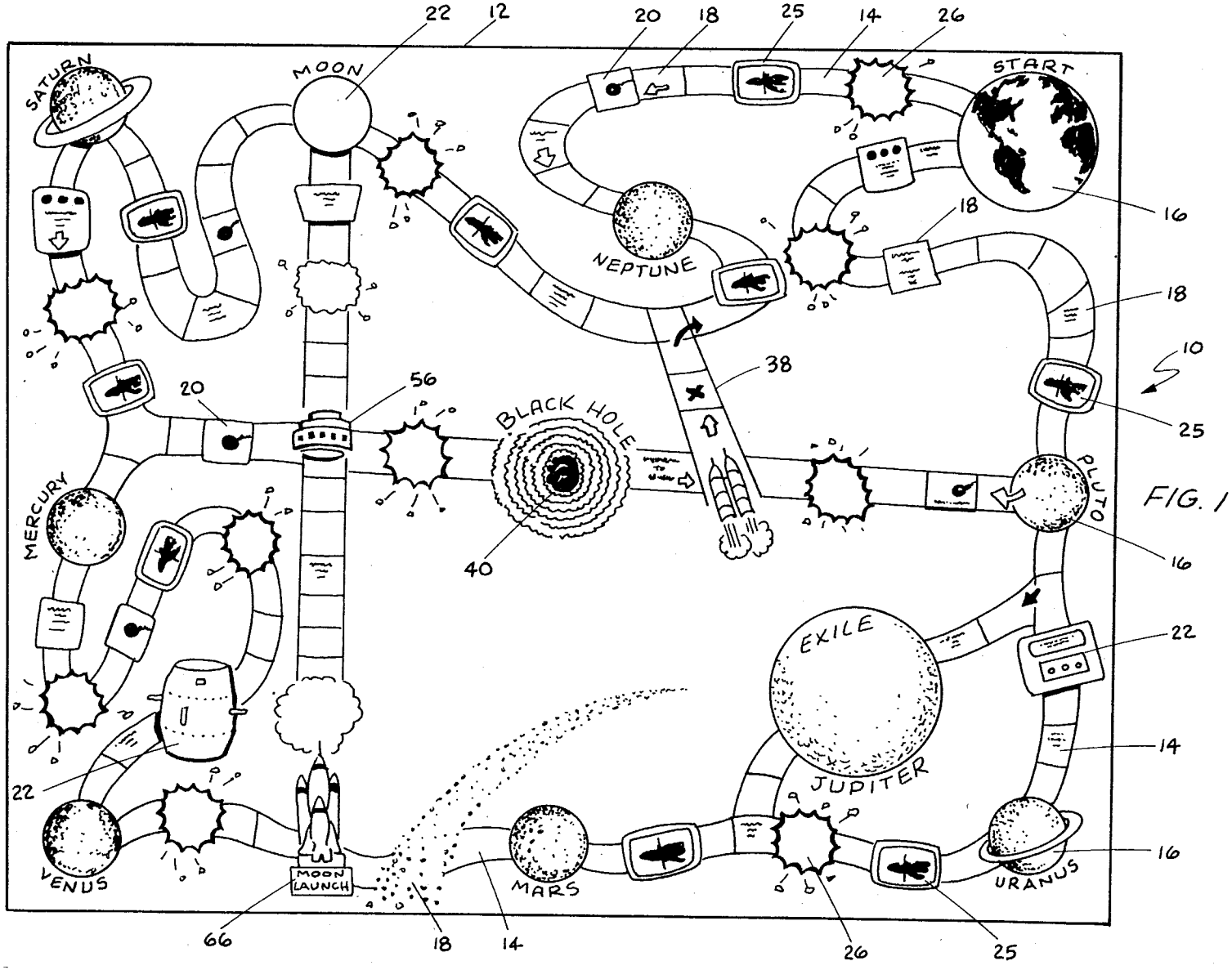
FIG. 1 is a top plan view of the game board showing the plurality of playing spaces.

Referring now in detail to FIGS. 1 through 5, there is shown a space combat game according to the teachings of the present invention with the game 10 including a game board 12 having a play surface made of any suitable material, and having a plurality of playing spaces 14 disposed in a continuous path along the surface thereof. The playing spaces 14, as depicted in FIG. 1, include a plurality of groups of spaces as particularly described herein.

Figure 4:
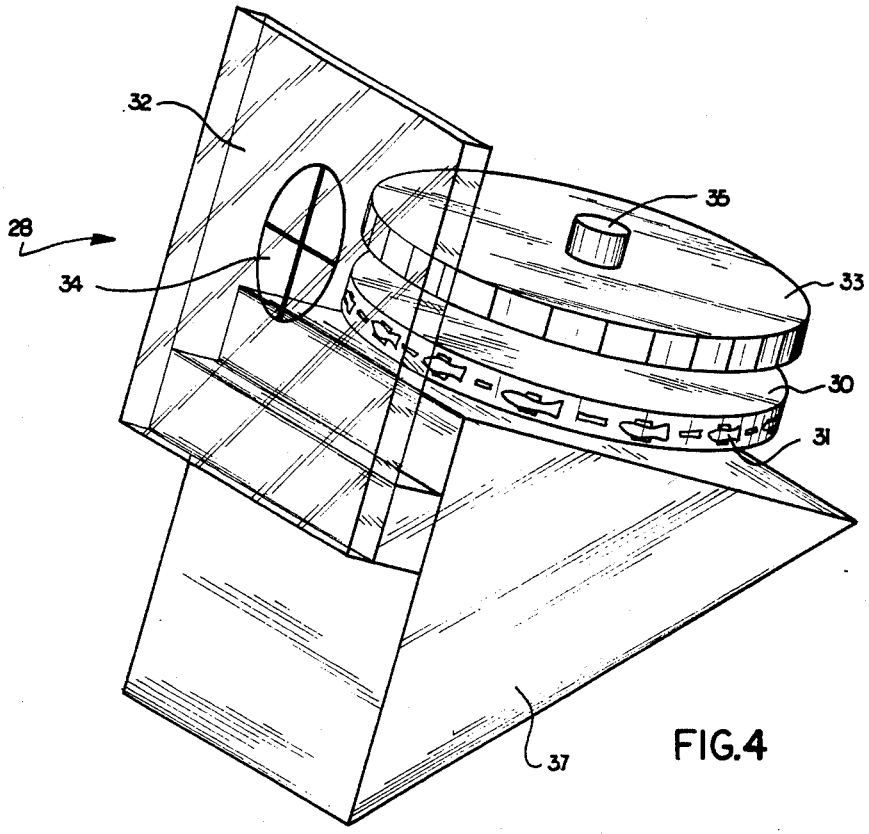
FIG. 4 is a perspective view of the second chance means.
Figure 5:
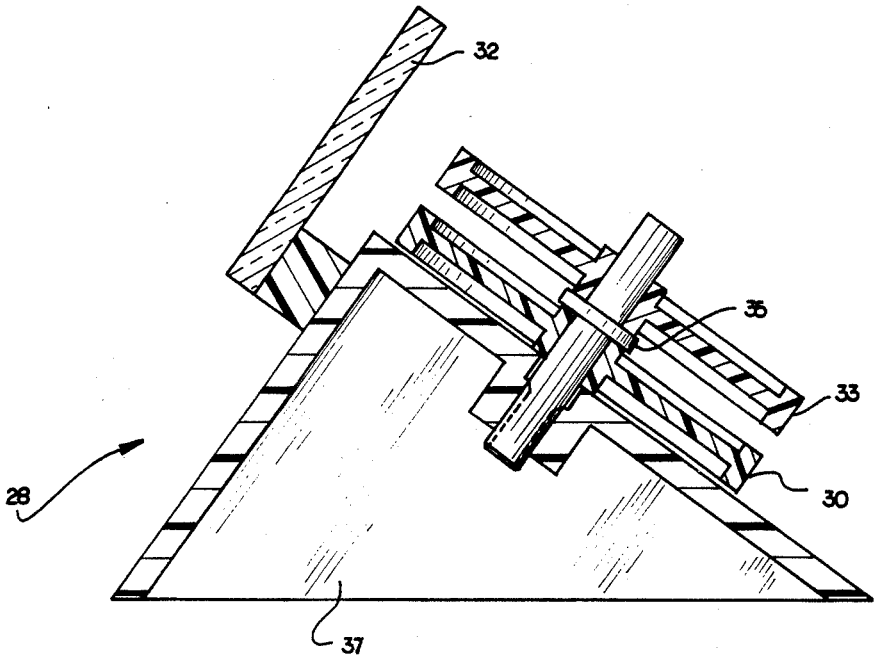
FIG. 5 is a side view, taken in cross-section, of the second chance means.

A group of planetary spaces 16 is provided which includes the planets of the solar system, i.e. Earth, Pluto, Jupiter, Uranus, Mars, Venus, Mercury, Saturn and Neptune, and are spaced intermittently throughout the playing spaces 14. Players landing on a planet 16 will receive a galaxy card 17 which has indicia thereon comprising instructions to the player, as is more fully explained below. A group of directional spaces 18 is provided having indicia with instructions to control the movement of a player's marker 19 which has landed thereon. A group of internment spaces 20 is also included to provide another hazardous obstacle to the players. These particular spaces have indicia symbolizing a ball and chain with instructions to the player to exile or intern on Jupiter either a robot 21 or astronaut 23. These pieces can subsequently be freed by receiving the appropriate galaxy card, as is explained more fully hereinbelow. A group of control spaces 22 is provided to simulate lunar and man-made installations which may be found in the solar system. Mission Control, a Space Station and the Moon are provided as control spaces 22 and have particular significance, in terms of scoring, to a player who has landed on any of these spaces during the game. A group of battle spaces is also provided to simulate an actual battle in space between two players. Fire missile space 25 indicates that when a player lands thereon he must fire his missiles at all players having markers on a blast area space 26. In order to determine the outcome of an attack, the attacking player spins the second chance means 28, as shown in FIGS. 4 and 5, and particularly, spins the lowermost wheel 30 which has indicia about its circumference which symbolizes rocket ships 31. The wheel 30 is positioned on a base 33 by a rotating means 35. The rocket ships 31 are viewed through the viewing means 32 and particularly through the sight 34 which may be provided with one or more cross-hair configurations. By visually aligning the cross-hairs onto the lowermost wheel 30 the player can determine if the center of the cross-hairs is visually aligned with a rocket ship 31. If so, the attack is successful, and the attacking player receives a hit disk 36 which adds to the player's point total. If the attack is unsuccessful, the defender remains unharmed.

Another group of spaces is also provided, namely, a group of safety spaces 38 having indicia which provide a safety zone which a player attempts to land on when attempting to avoid the black hole space 40 or a capture galaxy card 17 as will be explained more fully hereinbelow.

Figure 2:
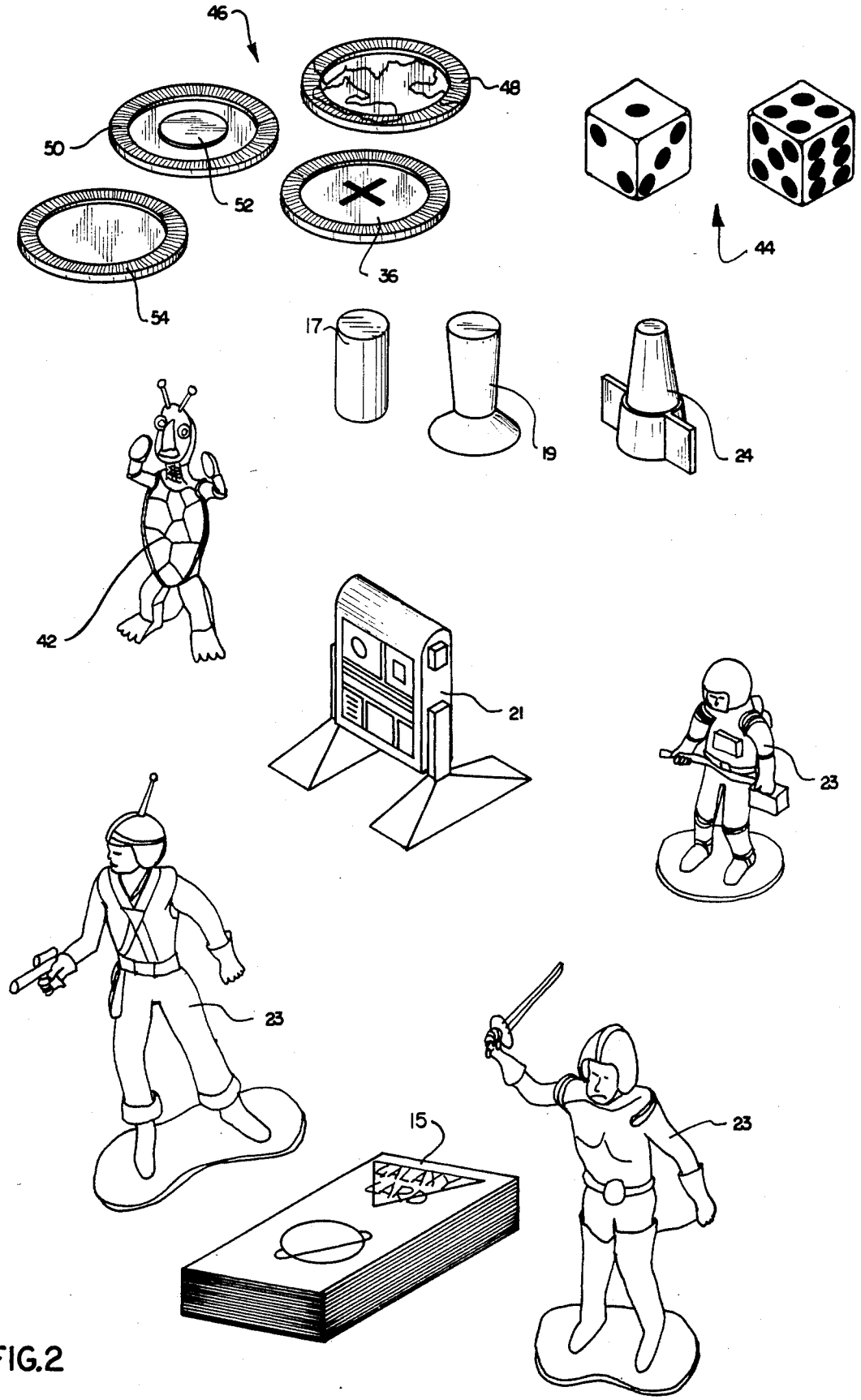
FIG. 2 is a perspective view of the various players' pieces, scoring disks, first chance means, and a stack of galaxy cards.

A plurality of player's pieces are provided, see FIG. 2, which include a marker 19, rocket ship 24, a robot 21 and various astronaut FIGS. 23. A typical martian 42 is shown and can be captured for points as explained hereinbelow. A first chance means 44, preferably dice, is provided to indicate the number of playing spaces 14 a player will move in a particular turn. Any other type of chance means, such as a spinner, can also be provided and is contemplated to be within the scope of the present invention.

Scoring disks 46 are provided to represent a variety of different objectives a player may achieve. A scoring disk 48 having indicia thereon is given to a player each time his marker 19 passes through Earth. The scoring disk 50 is awarded to the player who is in control of all the control spaces 22. Finally, disk 54 is awarded to a player who successfully achieves a lunar landing.

A scoring means 62 is also provided to represent the amount of points a player has achieved during the course of a game. The game has ended when a single player loses all of his rocket ships or astronauts and robots. All players then total their points received and the player with the highest point total wins.

Rules of Play

The space combat game of the present invention may be played by two or more players. The object of the game is for one of the players to obtain a maximum number of points during the play of the game.

Initially, a player selects a particular color of game pieces with which color he will be identified with during the entire game. In conjunction therewith, and before the beginning of play, each player receives the following game pieces: one marker 19; six rocket ships 24; four robots 21; and a total of twelve astronauts 23. The selected markers 19 are positioned on the planetary space 16, Earth, and are moved along playing spaces 14 in accordance with the numbers rolled on the first chance means or dice 44. Play begins with the player who throws the highest number on the dice 44 and proceeds from player to player in a clockwise direction.

Each player, starting with the first player, rolls the dice 44 and moves his marker 19 around the board from the starting position, Earth. As each player moves his marker 19, the piece will inevitably land on a multitude of different groups of spaces each having a different effect on the player's marker 19 and point total. For the sake of brevity and clarity the following is a list of the types of spaces and the rules governing each.

Planetary Spaces: The player who lands on any planet except Earth, Pluto, and Jupiter immediately draws a galaxy card and follows the indicia printed thereon. The galaxy cards 15 have various instructions directed toward the movement of the players pieces on the game board 12. The card 15 may tell the player to go to the space platform 56 or to capture a martian piece 42. Further, the cards may allow one player to attack another, or provide a force field protector 17 on a player. More particularly, the galaxy cards 15 provide additional instructions for the movement of the markers 19 on the game board 12. However, the galaxy cards 15 also provide the instructions pertaining to capturing another player. If a player draws a capture card, which indicates the color of marker 19 to be captured, the player moves his marker 19 to the space where the same colored marker 19 is. The attacking player spins the topmost wheel 33, of second chance means 28, see FIGS. 4 and 5, which has indicia on its circumference. The wheel has alternately blue and white colored bands thereon. Should the cross-hairs 34 have a portion thereof in line with a white band, the capture succeeds and either a robot 21 or astronaut 23 of the captured player is turned over to the attacker. Should a miss occur, then the defending player has an opportunity to retaliate and become the attacker and follow the same procedure as outline above. A capture may not take place on the Earth or a safety space as defined below.

Directional spaces: These spaces 18 have indicia which further instruct the player who has landed thereon about additional movement of his marker. As shown in FIG. 1, the player may have to move a specified number of spaces, or move across the solar system to a planet, or some other destination, i.e. Mission Control.

Internment Spaces: These spaces 20 have indicia representing a ball and chain to indicate that a player landing on this space must exile to Jupiter a robot 21 or astronaut 23 as indicated. Some galaxy cards 15 provide for the releasing of the interned pieces.

Control Spaces: These spaces 22 include Mission Control, the Moon and the Space Station. A player landing on any of these spaces can optionally place an astronaut 23 on it and is considered to be in control thereof and accordingly receives a predetermined number of points as described below. Any player subsequently landing on a control space having an astronaut thereon captures the astronaut previously placed on it and receives points for gaining control of the space.

Battle Spaces: A player landing on a fire missile space 25 attacks all players who have their markers on the blast area spaces 26. The attacker spins the lowermost wheel 30 to determine whether the attack was successful, by aligning the cross-hairs with the image of the rocket ship placed on the circumference of wheel 30. If the attacker has a hit, a scoring marker 36 is received and the player hit loses one rocket ship 24, one astronaut 23, and returns to Earth. If more than one player is on the blast areas 26 this one spin by the attacker applies to all players and the abovedescribed rules apply.

Safety Spaces: These spaces 38 provide one of the only areas where a player cannot be captured by another. Further, this area is located near the black hole space 40 and can be used as an alternative route around this hazard.

Accordingly, after the players travel about the playing board 14, play continues until one player has lost all allotted rockets or astronauts and robots. When this occurs, the players then total all scoring disks hits, controls, captures and their remaining force, as is more fully explained below.

Scoring

Figure 3:
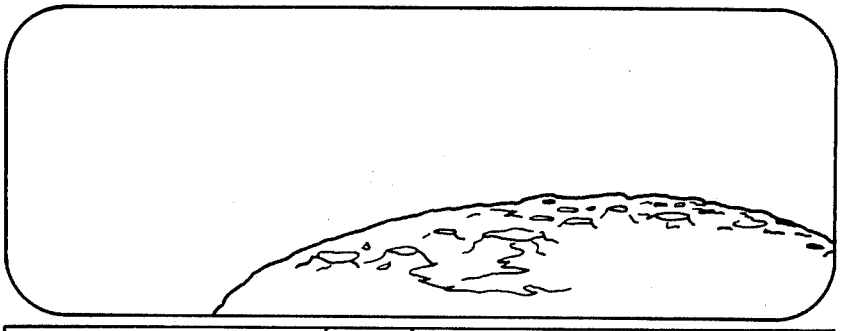
FIG. 3 is a front view of the scoring means.

As is shown in FIG. 3, a scoring means 62 is provided to accurately register a player's score at the end of play. A score card 64 or page is provided with indicia describing each category of points possibly awarded to the particular player. For clarity and brevity, each category is more particularly described below.

Trips: A galaxy trip, registering 50 points, is represented by scoring disk 48, or Earth disk, and represents a trip by a player through Earth. A moon trip is represented by scoring disk 54 and has the highest amount of points awarded, 300, and occurs when a player lands on the moon launch space 66 and attempts to land on the Moon 22. The player must roll the die 44 and attempt to land directly on the Moon 22 and not just pass through it. For each time during the game a player successfully lands on the Moon 22, as described above, a scoring disk 54 is received.

Hits: For each hit on the enemy in a blast area space 26 a player receives 100 points. The scoring disk 36 represents each hit.

Controls: As explained above, the player at any time in control of Mission Control (200 points), Moon Control (150 points), or the Space Station (100 points) receives the requisite number of points. Any player in control of all three control spaces 22 at any time during the play of the game receives an additional 150 points.

Captures: As explained above, capturing another player's piece receives a number of points. A robot receives 150 points, while an astronaut receives 100 points. If a martian has been captured, and this can only be done by drawing the proper galaxy card, the player receives 50 points.

Remaining Force: When one player has lost all rockets or robots and astronauts, the players total all of their remaining forces. Players count all remaining game pieces, including robots (70 points), astronauts (60 points) and rocket ships (50 points) and add this into the final point total.

After totalling the scores the player with the highest total is declared the winner.

From the foregoing, it is apparent that the objects of the present invention have been fully accomplished. As a result of the present invention a new and improved space combat game has been disclosed. A preferred embodiment of the principles of this invention having been described and illustrated, it is to be realized that the same are not limited to the particular space combat game configuration shown in the drawings, and that modifications thereof are contemplated and can be made without departing from the spirit and scope of this invention as defined in the appended claims.

What is claimed is:

1. A space combat game comprising:

a game board with a play surface having indicia defining a plurality of playing spaces which cooperatively define a continuous path of the players;

a plurality of distinct play pieces selected and used by each player and moved along said playing spaces in said continuous path;

a first chance means for randomly determining the number of playing spaces a play piece may be moved along during a player's turn;

a second chance means for randomly determining the outcome of an attack by a player on another player, said second chance means includes a base having a rotating means projecting therefrom with two wheels rotatably and centrally disposed about said rotating means, said wheels being independently rotatable, each in a plane substantially parallel to said base, and said wheels further having indicia on their outer circumference; said second chance means further including a substantially transparent viewing means attached to said base and having a sight printed thereon, whereby upon rotation of either or both wheels about said rotating means, the circumferential indicia on said wheels can be viewed through the viewing means and in relation to said sight;

a plurality of galaxy cards, each of said cards having indicia thereon for instructing the movement of said play pieces;

a plurality of scoring markers for representing a player's score; and a scoring means for indicating a player's total score.

2. A space combat game as defined in claim 1, said playing spaces including a group of planetary spaces having indicia depicting a plurality of planetary bodies.

3. A space combat game as defined in claim 2, said plurality of planetary bodies including Earth, Pluto, Uranus, Jupiter, Mars, Venus, Mercury, Saturn and Neptune.

4. A space combat game as defined in claim 1, said playing spaces including a group of directional spaces having indicia comprising instructions for the movement of said play pieces.

5. A space combat game as defined in claim 1, said playing spaces including a group of internment spaces having indicia comprising instructions for the movement of a player's piece to a planetary body.

6. A space combat game as defined in claim 5, said planetary body comprising Jupiter.

7. A space combat game as defined in claim 1, said player spaces including a group of control spaces having indicia comprising instructions for moving said player's piece to a plurality of control stations.

8. A space combat game as defined in claim 7, said plurality of control stations including a mission control, a space station and a Moon.

9. A space combat game as defined in claim 1, said play spaces including a group of battle spaces having indicia thereon.

10. A space combat game as defined in claim 1, said play spaces including a group of safety spaces having indicia thereon.

11. A space combat game as defined in claim 1, said playing spaces including a moon launch space.

12. A space combat game as defined in claim 1, said players pieces including a marker, a plurality of robots, a plurality of astronauts and a plurality of rocket ships.

13. A space combat game as defined in claim 1, said first chance means comprising a die.

14. A space combat game as defined in claim 1, said plurality of scoring disks comprising Martian play pieces, moon disks, earth disks, control disks, and hit disks.

15. A space combat game as defined in claim 1, said scoring means comprising a score sheet having indicia thereon.

* * * * *